US007371144B1

(12) United States Patent
Begien et al.

(10) Patent No.: US 7,371,144 B1
(45) Date of Patent: May 13, 2008

(54) SAND SCULPTURE KIT AND A METHOD FOR CREATING AND DECORATING A SAND SCULPTURE

(76) Inventors: Patrick Clay Begien, 1933 Margie, Whitelake, MI (US) 48386; Barry M. Sokol, 8326 Hummingbird Dr., Commerce, MI (US) 48382

( * ) Notice: Subject to any disclaimer, the term of this patent is extended or adjusted under 35 U.S.C. 154(b) by 49 days.

(21) Appl. No.: 11/344,919

(22) Filed: Feb. 1, 2006

(51) Int. Cl.
*A63H 33/32* (2006.01)
*A63H 33/00* (2006.01)

(52) U.S. Cl. ..... 446/70; 434/84; 206/1.7

(58) Field of Classification Search ..... 446/70; 472/126; 206/1.7, 1.8, 1.9, 575; 434/84
See application file for complete search history.

(56) References Cited

U.S. PATENT DOCUMENTS 3,447,256 A * 6/1969 Compton ..... 446/70
3,840,113 A * 10/1974 Bartleson ..... 206/575
4,322,004 A 3/1982 Schwuchow
4,480,744 A * 11/1984 Blackmon ..... 206/1.7
4,935,631 A * 6/1990 Mosley et al. ..... 250/458.1
5,107,123 A * 4/1992 Shi ..... 250/372
5,165,966 A 11/1992 Adams
5,380,237 A 1/1995 Kenyon
5,460,561 A 10/1995 Dahlgren
5,720,614 A * 2/1998 Pestano ..... 434/82
5,730,293 A * 3/1998 Kelly et al. ..... 206/575

FOREIGN PATENT DOCUMENTS

| | | |
|---|---|---|
| CA | 2254402 | 11/1998 |
| GB | 180518 | 6/1922 |
| GB | 187412 | 10/1922 |
| GB | 906062 | 9/1962 |

OTHER PUBLICATIONS

Mr PC Clean-Falcon PLUS Air Duster, 2 Pages, Web Printout.
Mr PC Clean-Falcon PLUS Air Duster Refill, 2 Pages, Web Printout.
Spray Master Spray Bottle, 2 Pages, Copyright 2005, SmartPak Equine LLC, Web Printout.

* cited by examiner

*Primary Examiner*—Kien T Nguyen
(74) *Attorney, Agent, or Firm*—Law Offices of John Chupa & and Associates, P.C.

(57) ABSTRACT

A kit 10 which includes various implements, such as a container 12, a pair of sunglasses, 40 suntan lotion 45 and a flag 44, colors container 110, 112, 114, and 116 which allows an aesthetically pleasing sand sculpture 200 to be safely and efficiently created. Particularly, some of the implements, such as the lotion 45, are utilized to protect the user of the kit, the container 12 may worn the user of the occurrence of an undesirably high temperature or ultraviolet radiation condition, and the container 110-116 may be used to selectively create a colorful design upon the created sculpture 200.

1 Claim, 4 Drawing Sheets

SAND SCULPTURE KIT AND A METHOD FOR CREATING AND DECORATING A SAND SCULPTURE

GENERAL BACKGROUND

1. Field of the Invention

The present invention generally relates to a sand sculpture kit and to a method for creating and decorating a sand sculpture and more particularly, to a kit which may be used to safely and dynamically create an aesthetically pleasing sand sculpture.

2. Background of the Invention

A sand sculpture, such as that which is often referred to as a "sand castle", is often created by children or young adults at the beach and is often considered a source of pleasure and enjoyment both for the creators as well as for the spectators who watch the activity and/or appreciate the finished sculpture.

Conventionally, the sand sculpture is created by selectively acquiring and forming sand (e.g., such as that which is located on a beach) into a certain desired shape or spatial orientation or configuration (e.g., such as in the form of a house or castle). While this approach does allow a desired configuration to be spatial achieved, it suffers from some drawbacks.

By way of example and without limitation, the created sculpture is only a single color (e.g., the color of the sand) which some people find to be un-aesthetically displeasing. Further, due to the "single colored nature" of these sand sculptures, it is difficult, when many of these sculptures are placed or formed in close proximity to one another, to "tell them apart" or to distinguish them, thereby preventing a truly novel sculpture from receiving the desired and justified notice and acclaim.

Further, due to the depletion of the protective ozone layer and the concomitant and undesired increase in potentially damaging ultraviolet rays, it may be dangerous, depending upon the time of year and the locality, especially for young children or the elderly, to be at the beach for an extended period of time. This danger emanates both from the harmful effects of these ultraviolet rays and the general harmful effect of overexposure to sunlight. Some protection measures, such as the wearing of a hat or the application of suntan lotion, may mitigate against these exposure risks, however even these measures, depending upon the strength of the ultraviolet environment in which the beach is located, may be insufficient. Many individuals fail to take appropriate protective measures for themselves and/or for their parents or children to protect themselves against the effect of these harmful ultraviolet rays or sunlight and when one is engrossed in creating or observing sand sculptures, one may even forget to consider the harmful effects of sunlight or ultraviolet rays, or even to take appropriate measures.

The present invention overcomes these and other disadvantages of prior sand sculpturing techniques and methodologies in a new and novel manner.

SUMMARY OF THE INVENTION

It is a first non-limiting object of the present invention to provide a sand sculpture kit which allows for the selective creation of a sand sculpture in a new and novel manner.

It is a second non-limiting object of the present invention to provide a sand sculpture kit which allows for the selective creation of a sand sculpture in a relative safe and in a new and novel manner.

It is a third non-limiting object of the present invention to provide a method for constructing a sand sculpture in a safe and in a new and novel manner.

It is a fourth non-limiting object of the present invention to provide a method for decorating a sand sculpture in a safe and in a new and novel manner.

According to a first non-limiting aspect of the present invention, a sand sculpture kit is provided and includes a package; a plurality of coloring agents; a pair of sun glasses; suntan lotion; an umbrella; and an instruction booklet, wherein the plurality of coloring agents, the pair of sunglasses, the suntan lotion, the umbrella, and the instruction booklet are collectively disposed within the container.

According to a second non-limiting aspect of the present invention, a method for decorating a sand sculpture is provided and includes the steps of providing a plurality of selectively mixable colored applicants; causing at least some of the selectively mixable colored applicants to be mixed, thereby forming a desired colored applicant; causing the desired color applicant to be applied to the sand sculpture; providing a flag; and causing the provided flag to be applied to the sand sculpture.

According to a third non-limiting aspect of the present invention, a method for decorating a sand sculpture is provided and includes the steps of providing a plurality of selectively mixable colored applicants; causing at least some of the selectively mixable colored applicants to be mixed, thereby forming a desired colored applicant; causing the desired color applicant to be applied to the sand sculpture; providing a flag; and causing the provided flag to be applied to the sand sculpture.

These and other features, aspects, and advantages of the present invention will become apparent from a reading of the following detailed description of the preferred embodiment of the invention, including but not limited to the subjoined claims, and by reference to the following drawings.

DETAILED DESCRIPTION OF THE PREFERRED EMBODIMENT OF THE INVENTION

Figure 1:
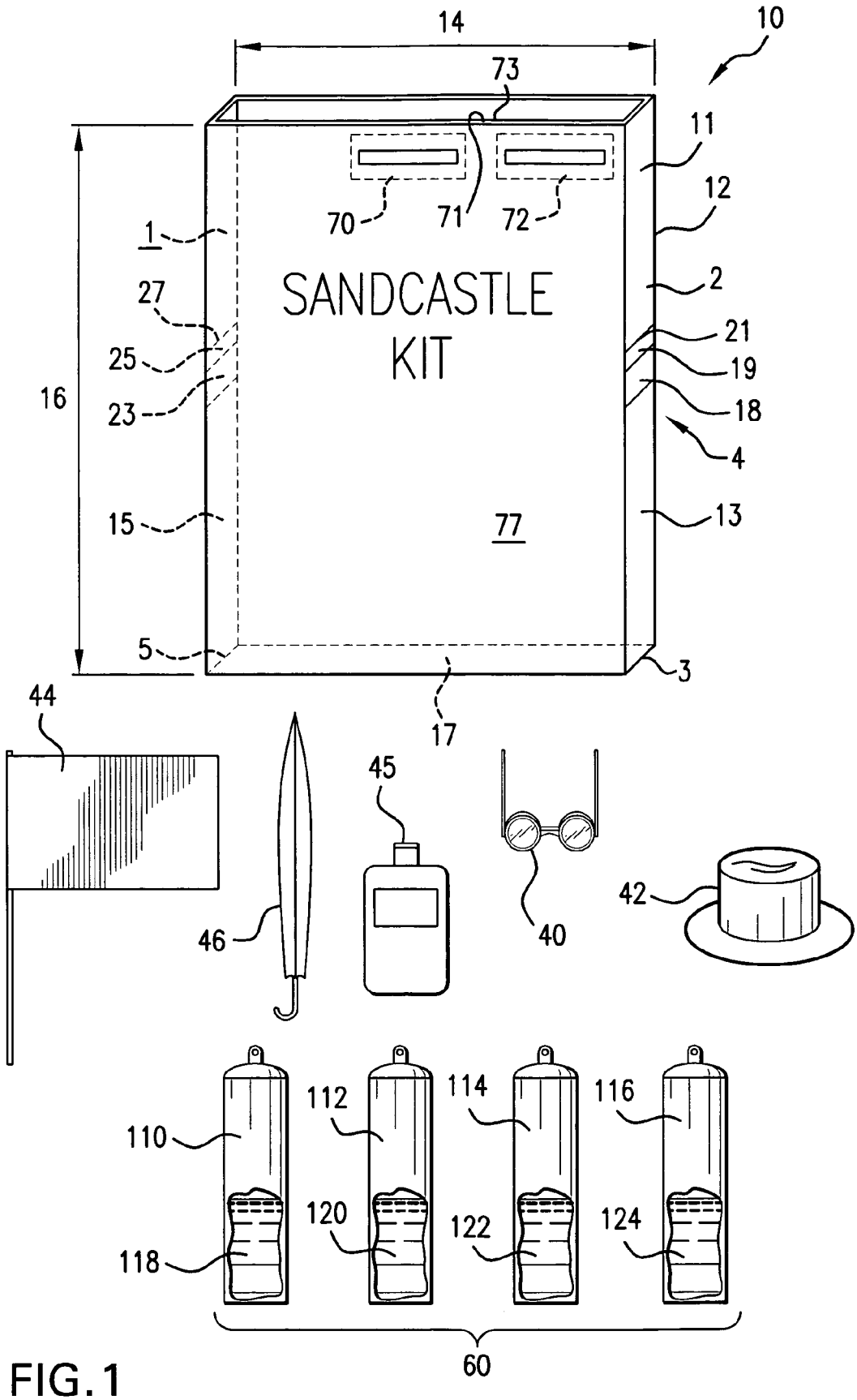
FIG. 1 is an unassembled view of a sand sculpture kit assembly which is made in accordance with the teachings of the preferred embodiment of the invention.

Referring now to FIG. 1, there is shown a sand sculpture creation kit assembly 10 which is made in accordance with the teachings of a first non-limiting and preferred embodiment of the invention and which is selectively used by the various methodologies and strategies of the present inventions.

Particularly, the assembly 10 includes a generally hollow bag, container, or receptacle 12 having, in one non-limiting embodiment, a width 14 of about seven to about eight inches and a height 16 of about ten to about twelve inches. Other height and widths may be utilized.

Figure 5:
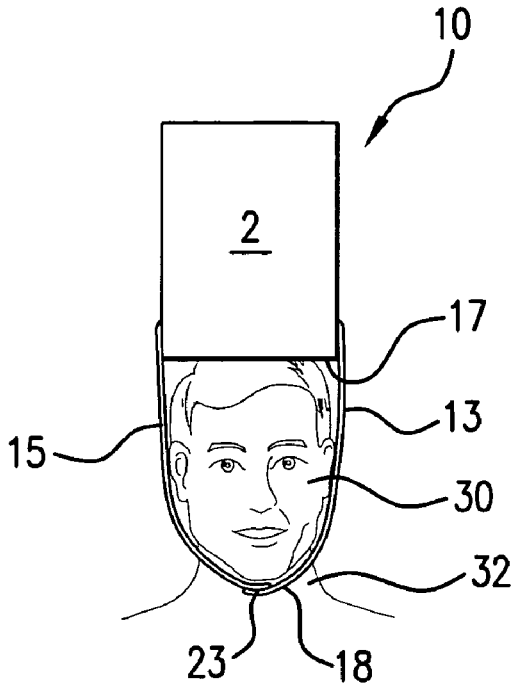
FIG. 5 is a side view of a portion of the assembly which is shown in FIG. 1 being selectively used as a hat.

In this non-limiting embodiment, as is perhaps best shown in FIGS. 1 and 5, the container 12 includes first and second arm members or portion 13, 15 which are respectively and pivotally coupled to the body 2 of the container 12 along respective seams 3, 5. Particularly, the member 13 includes a distal end 4 having a first hook type or VELCRO® portion 18 and a second opposed hook type VELCRO® portion 19. The container 10 includes a first ring type VELCRO® portion 21 on the body 2 (e.g., on the side portion 11). Similarly, the portion or member 15 includes a first ring type VELCRO® portion 23 and a second opposed ring type VELCRO® portion 25. The container 10 includes a second hook type VELCRO® portion 27 on the body 2 (e.g., on the side portion 1 opposite to side portion 11).

In this manner, as is best shown in FIG. 1, the arm member 13 may be secured to the body 2 (e.g., to the side portion 11) of the container 12 by having portion 19 selectively contact portion 21. Similarly, the member 15 may be secured to the body 2 (e.g., to the side portion 1) by having portion 25 selectively contact portion 27. However, each of the members 13, 15 may also be selectively and independently removed from their respective stored position, which is shown in FIG. 1, to a respective and operative position which is shown in FIG. 5 by having portion 25 pulled away from portion 27 and/or by having portion 19 pulled away from portion 21. In this manner, the body 2 of the container 10 (e.g., the closed bottom end 17) may be protectably placed on a head 30 of an individual and the body 2 may be secured to the head 30 by having member 13 be secured to member 15 around the neck 32 of the individual. Particularly, the member 13 is secured to the member 15 by having portion 23 contact portion 18. Of course, the container 10 may be later removed from the head 30 and the arm members 13, 15 may be independently and selectively placed in the stored position which is shown in FIG. 1.

As shown best in FIG. 1, the kit assembly 10 further includes a pair of sunglasses 40, a protective hat 42, a flag 44 which may be selectively inserted within the completed sand structure, an umbrella 46, a container of suntan lotion 45, and a plurality of coloring agents or applicators 60. The items 40, 42, 44, 45, 46, and 60 may hereinafter be collectively referred to as "implements". It should be appreciated that in other alternate embodiments of the inventions, not all of the above-referenced implements may be provided within the container 12 and that some, all, or none of the implements may be provided as part of the assembly 10.

Further, as shown in FIG. 1, the container 12, in one non-limiting embodiment of the invention, includes a thermometer 70 and an ultraviolet meter assembly 72. More particularly, in one non-limiting embodiment, the body 2 of the container 12 is composed from at least a "two ply" plastic transparent material (e.g., layers 71, 73 which are adhered together, such as by give or another substance) and the thermometer 70 and the ultraviolet meter assembly 72 are operatively deployed within the front surface 77 of the container 12 between the two layers of material 71, 73. In another non-limiting embodiment, only the front surface 77 is transparent while the remainder of the body 2 of the container 10 is opaque.

The thermometer 70 will allow a user to view the temperature of the ambient environment and the ultraviolet meter 72 will also allow a user to view the amount of ultraviolet radiation occurring in the environment in which the sand sculptures are being constructed (e.g., presumably close to where the container 12 is placed). In this manner, the user may safely be moved and/or move the user's children or other loved ones away from the environment if the temperature and/or amount of ultraviolet radiation exceeds a desired or safe limit. Further, the hat 42, the umbrella 46, the sunglasses 40, and the suntan lotion 45 protect the participants or user of the system 10 and the container 12 itself may be used as a protective hat. In this way, the sand sculptures may be created in a relatively safe manner. In a non-limiting embodiment, the thermometer 70 and ultraviolet meter assembly 72 may not be provided as part of the overall system 10.

Figure 6:
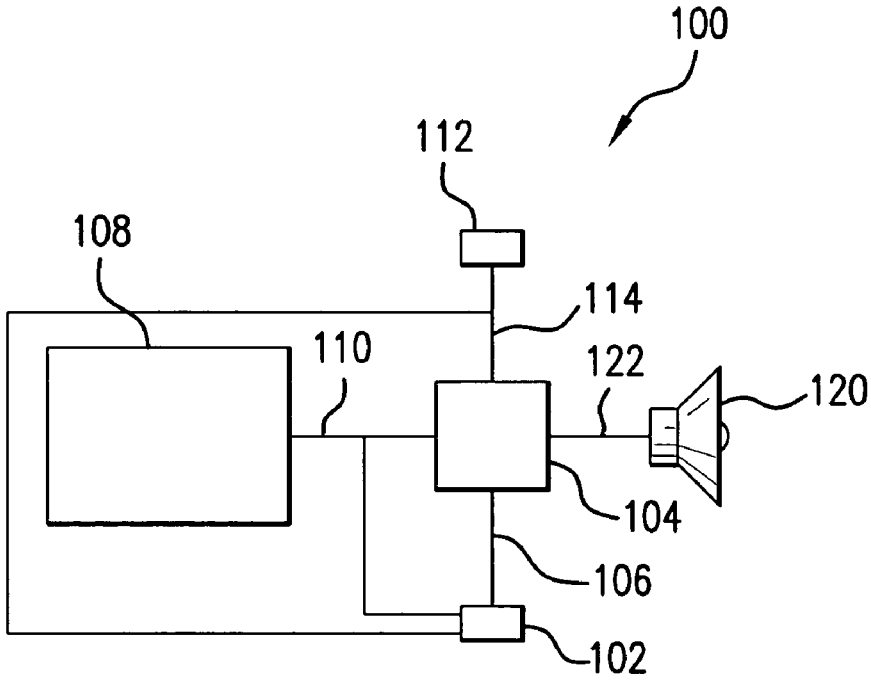
FIG. 6 is an electrical block diagram of the ultraviolet measurement and indicator assembly which is shown in FIG. 1 and which may be selectively and operatively located within a container.

Referring now to FIG. 6, there is shown a non-limiting embodiment of an ultraviolet meter assembly 100 (which is substantially identical to assembly 72) which may be used by the invention. Particularly, in this non-limiting embodiment, the meter assembly 100 includes a source of electrical power 102 (e.g., a battery or a solar cell), a controller 104 which is operable under stored program control and which is coupled to the source of energy 102 by the use of bus 106, a display portion 108 which is coupled to the controller 104 and to the source of electrical power 102 by the use of bus 110, and an ultraviolet radiation sensor 112 which is coupled to the controller 104 and to the some of electrical power 102 by the use of the bus 114. The assembly 100 further includes an audible annunciator 120 which is coupled to the controller 104 by the use of the bus 122.

In operation, the sensor 112 continuously senses the amount of ambient ultraviolet radiation and continually communicates this amount of sensed radiation to the controller 104 by the use of bus 114. The controller 104 communicates the amount of continuously sensed radiation to the display 108 by the use of bus 110 and, in this manner, the user of the system 10 may visually and continually recognize the amount of continually sensed ultraviolet radiation. Further, should the amount of the continuously sensed radiation exceed some threshold, which is selectively stored within the controller 104, then the controller 104 generates a signal (e.g., sources energy from the source 102 to the portion 120) upon the bus 122 which is effective to cause the alarm portion 120 to issue an audible sound, and/or a visual indication, thereby warning those in close proximity to the container 12 that the amount of sensed ultraviolet radiation exceeds a certain threshold limit, thereby indicating that the user should move to safety (e.g., the display portion 108 is visible through the transparent material 71 and the surface 70).

Further, the group of applicators 60 include, in this first non-limiting embodiment of the invention, aerosol cans 110, 112, 114, and 116 having respective material 118, 120, 122, and 124 having the respectively unique color of green, red, blue, and brown (or some other respectively desired color). In one non-limiting embodiment of the invention, the material 118, 120, 122, and 124 respectively comprises food coloring (of a respective unique color) in combination with some aerosol material or expellant material, such as that used to selectively expel hairspray type material or other types of material from an aerosol can.

Figure 4:
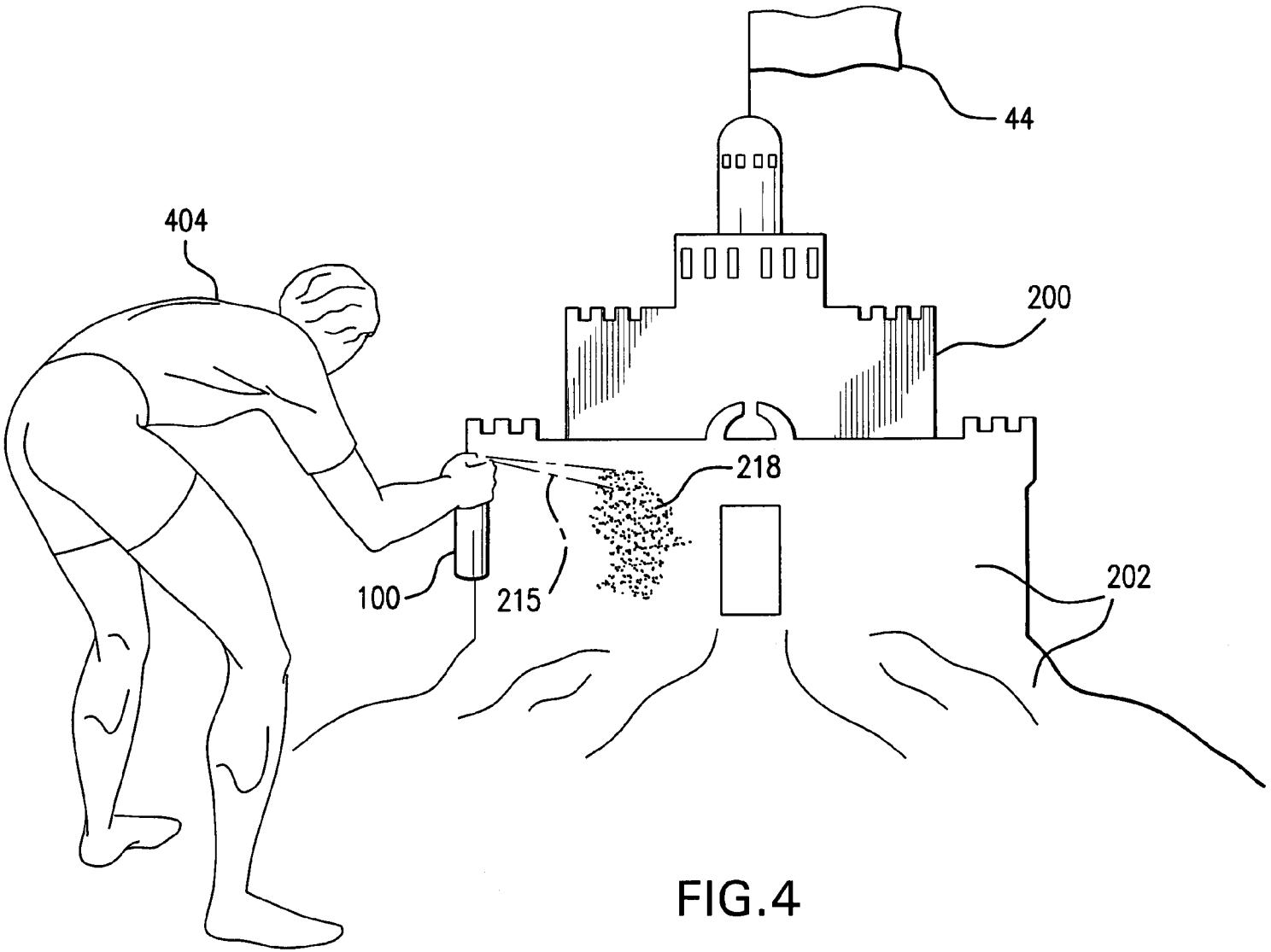
FIG. 4 is a perspective view of a sand sculpture being created and decorated by the use of a dynamically created color applicator or agent according to the various teachings of the present inventions.

As in perhaps best shown in FIG. 4, once a sand sculpture or sand structure 200 is built, the flag 44 may be placed on a desired portion of the created structure 200. It should be appreciated that such a structure 200 is created by forming sand 202 into the desired spatial shape, and that this structure 200 may have any desired shape and size.

After the structure 200 is completed (or during the creation process), the aerosol cans 110-116 may be independently and selectively used, by the creator, to selectively emit colored material 215 onto the created structure in order to create an aesthetically pleasing overall design 218 in a highly efficient manner and to create a sand sculpture having a desired color or combination of colors. It should be appreciated that other colors of material may be substituted for or added to the group 60 and that nothing in this description should limit the utilized coloring agents to a specific type or number of colors.

Figure 2:
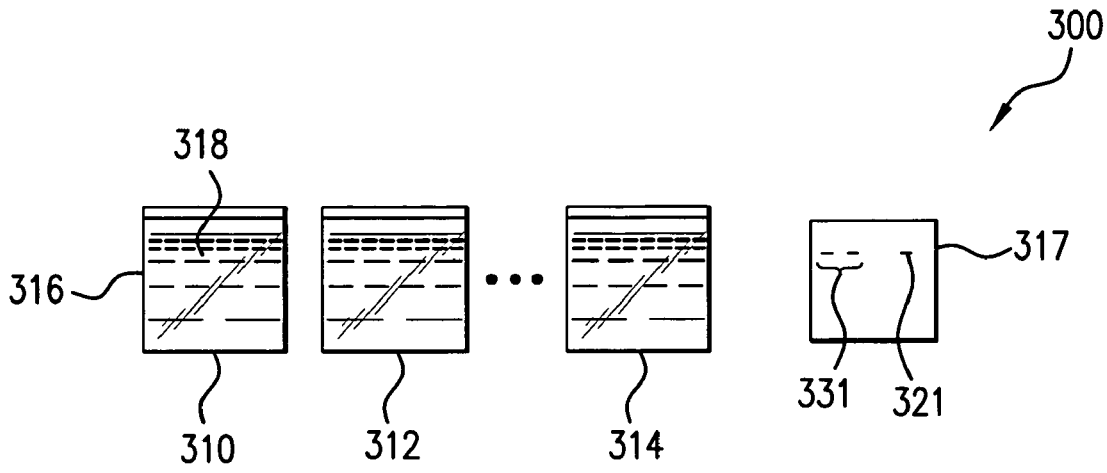
FIG. 2 is a side view of a plurality of unique coloring agents or applicants which are used by and which are incorporated within a sand sculpture kit assembly which is made in accordance with the teachings of a second non-limiting embodiment of the invention and which are used by the various methodologies of the present inventions.

Referring now to FIG. 2, there is shown a group of material or applicators 300 which are used within the kit type assembly 10 in place of the group 60 in one alternate, but non-limiting embodiment of the invention. In another non-limiting embodiment, groups 300 and 60 are each used in assembly 10.

Particularly, each such applicator of group 300, such as applicators 310, 312, and 314 comprise a substantially transparent (e.g., plastic) and selectively sealed receptacle 316 which respectively contain uniquely colored material 318 (e.g., respectively and uniquely colored powdered food coloring). One non-limiting example of a suitable container 310 comprises that which is generally known as a "baggie".

Figure 3:
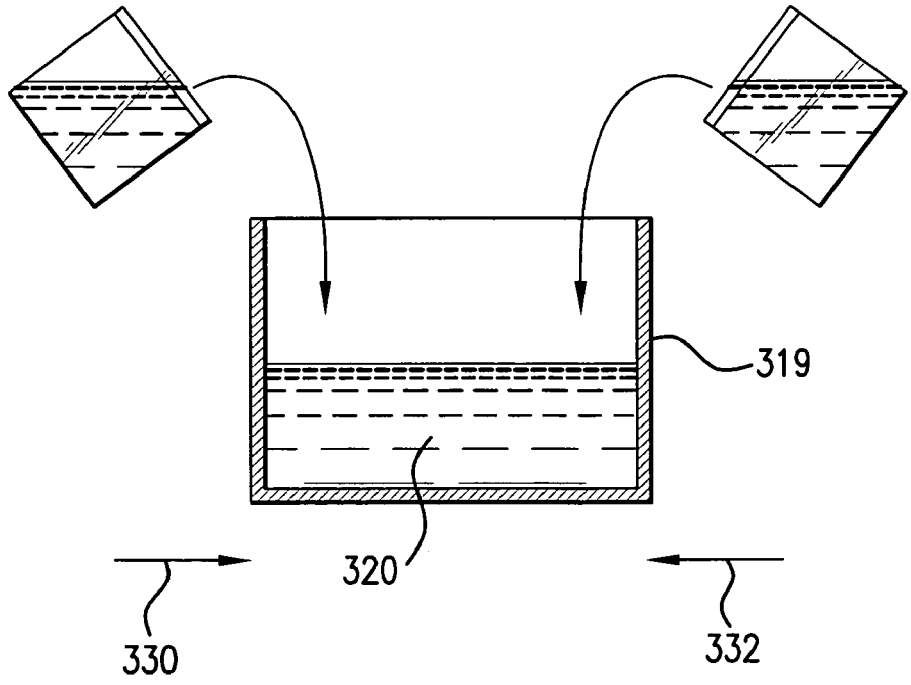
FIG. 3 is a diagrammatic view of some of the coloring applicants or agents, which are shown for example within FIG. 2, used to dynamically create a certain color applicator according to the teachings of one non-limiting methodology of the invention.

According to one non-limiting methodology of the invention and as is shown best in FIG. 3, a container 319 of water 320 or some other liquid is provided or created and selected material 318 from some or all of these applicators within the group 300, such as from applicators 310, 312, and 314, is placed within the contained liquid 320 as the liquid 320 is mixed or shaken or generally agitated (e.g., shown by arrows 330, 332).

After the combination of the originally provided/acquired liquid 320 and the selectively placed material 318 achieves the desired color, the combination may be selectively placed into a pump or other applicator 400 (e.g. such as a paint sprayer apparatus or such as a finger pump spray bottle such as that which is commercially known as a "Spray Master Spray Bottle", manufactured and/or provided by Delta Industries and which may be viewed on the web page denoted as www.smartpakquine.com). Other types of bottle assemblies may be alternatively employed. A user 404 may then selectively place the desired and created colored material onto a previously built sand structure 200 in order to form a desired design, such as design 218, on the sand structure 200 and achieving an aesthetically pleasing overall appearance.

Additional combinations of materials 318 may be made to form different colored material which may also be applied to the sand structure 200 in order to achieve a multi-color and multi-design arrangement in a very efficient and highly aesthetically pleasing manner.

In one non-limiting embodiment of the invention, should the applicator group 300 be employed as part of the kit assembly 10, then a color guide 317 may also be placed within the receptacle 12. This guide 317 includes a plurality of entries, such as entry 331, which respectively include a respectively associated final color picture and/or description 321. Particularly, a description 321 includes a written or textual description which describes the corresponding amount and type of material (such as, by way of example and without limitation, material 118, 120, 122, 124 and/or 318), needed to be mixed/agitated to form the desired color which is shown and/or described in the entry 331 that the description 321 is respectively and uniquely associated with (e.g., the entry 331 which is next to the description 321). In this manner, the user 404 simply looks to the guide 317 for a desired color and mixes the type and amount of material corresponding to the desired color. Of course, the user 404 is free to mix any type and any amount of the material that is desired and the guide 317 is not meant to be an exhaustive listing or guide to every conceivable color one may obtain by the use of applicator group 300, just a convenient reference guide.

In another non-limiting embodiment of the invention the kit assembly 10 can include premixed colors in one or more canisters ready for use with a finger pump spray nozzle or another type of spraying assembly wherein, the assembly of the spray nozzle and the premixed canisters may be substantially similar to the physical assembly of the Falcon Air Duster refill canister and the associated Spray Nozzle which are described, for example, within the web page entitled www.mrpcclean.co.uk (e.g., the color mixture may be placed within the canister). Other types of substantially similar "refill type nozzle assemblies" may be alternatively utilized.

It is to be understood that the present invention is not limited to the exact construction or methodology which has been illustrated above, but that various modifications may be made without departing from the spirit and the scope of the various non-limiting inventions as are more fully delineated in the following claims. It should be further understood and appreciated that the applicator group 300 allows the user 404 to dynamically select and mix colors and achieve unique color combinations "on the fly" in order to allow various single or multicolored designs to be incorporated or placed onto the sand structure 200. Further, the contained implements allows a user, such as user 404, to officially and quickly create a desired sand sculpture 200.

What is claimed is:

1. A sand sculpture kit comprising:

a container having a body with a front surface, wherein said body being formed from a first transparent layer of material and a second transparent layer of material wherein said first transparent layer of material is adhered to said second transparent layer of material to cooperate with said second transparent material to form a two ply body, said body further having a first hook type portion and a second ring type portion, wherein said container further having a first arm member having third and fourth hook type portions and wherein said third hook type portion of said first arm member being selectively secured to said second ring type portion of said body in a first stored position, and said container further having a second arm member having fifth and sixth ring type portions, wherein said fifth ring type portion of said second arm member being selectively secured to said first hook type portion of said body in a second stored position, and wherein said first arm member is selectively movable to a third operative position remote from said second ring portion and wherein said second arm member is selectively movable to fourth operative position remote from said first hook portion by selectively securing said fourth hook type portion of said first arm member to said sixth ring type portion of said second arm member, thereby selectively securing said first arm member to said second arm member and allowing said secured first and second arm members to be selectively positioned about a head of an individual in a manner which allows said body to cover said head;

a thermometer operatively disposed between said first layer of material and said second layer of material of said container, wherein said thermometer includes a display portion which is viewable through said front surface of said first transparent layer of material;

an ultraviolet meter operatively disposed between said first layer of material and said second layer of material of said container, wherein said ultraviolet meter includes a display portion which is viewable through said front surface of said first transparent layer of material by a user;

a plurality of aerosol applicators which selectively and removably reside within said bag, wherein each of said plurality of aerosol applicators having a unique colored substance and each of said plurality of aerosol applicators being adapted to selectively emit said respective colored substance upon a selected portion of sand, thereby allowing said portion of sand to be in a desired color;

a pair of sunglasses which selectively and removably resides within said container;

suntan lotion which selectively and removably resides within said container;

an umbrella which selectively and removably resides within said container; and an instruction booklet which removably resides within said container.

* * * * *